US011851837B2

(12) United States Patent
Florean

(10) Patent No.: US 11,851,837 B2
(45) Date of Patent: Dec. 26, 2023

(54) HYDRAULIC POWER SHOVEL WITH TAMPING FUNCTION

(71) Applicant: Robert Bosch GmbH, Stuttgart (DE)

(72) Inventor: Gilles Florean, Lyons (FR)

(73) Assignee: Robert Bosch GmbH, Stuttgart (DE)

( * ) Notice: Subject to any disclaimer, the term of this patent is extended or adjusted under 35 U.S.C. 154(b) by 587 days.

(21) Appl. No.: 17/115,419

(22) Filed: Dec. 8, 2020

(65) Prior Publication Data

US 2021/0172141 A1 Jun. 10, 2021

(30) Foreign Application Priority Data

Dec. 9, 2019 (FR) ..... 1913948

(51) Int. Cl.

| | |
|---|---|
| ***E02D 3/046*** | (2006.01) |
| ***E02F 3/36*** | (2006.01) |
| ***E02F 3/65*** | (2006.01) |
| ***E02F 3/96*** | (2006.01) |

(52) U.S. Cl.

CPC ..... *E02D 3/046* (2013.01); *E02F 3/3663* (2013.01); *E02F 3/651* (2013.01); *E02F 3/962* (2013.01)

(58) Field of Classification Search

CPC ..... E02D 3/046; E02F 3/3663; E02F 3/651; E02F 3/962

USPC ..... 404/83

See application file for complete search history.

(56) References Cited

U.S. PATENT DOCUMENTS

2008/0047171 A1* 2/2008 Jalabert ..... E02F 3/966 414/722
2009/0044434 A1* 2/2009 Breuer ..... E02F 3/7618 60/426
2011/0013982 A1 1/2011 Prohaska
2011/0318155 A1 12/2011 Okamura et al.

FOREIGN PATENT DOCUMENTS

DE 11 2017 003 608 T5 6/2019
JP 2007-85093 A 4/2007

* cited by examiner

*Primary Examiner* — Raymond W Addie
(74) *Attorney, Agent, or Firm* — Maginot, Moore & Beck LLP

(57) ABSTRACT

A hydraulic power shovel includes a frame, a power cylinder, a hydraulic installation, and a control unit. The frame is configured to support a turret equipped with an arm terminated by a tool, such as a bucket having a tamping surface. The power cylinder is linked to the arm and is configured to press on the turret. The hydraulic installation includes an adjustable flow pump configured to supply the power cylinder via a slide valve and a hydraulic liquid tank. The control unit is linked to (i) a control member actuated by the operator and configured to generate a control signal, and (ii) a sensor configured to generate a sensor signal corresponding to a pressure and temperature of hydraulic liquid in the power cylinder. A vapour pressure diagram of the hydraulic liquid is available in the control unit.

4 Claims, 2 Drawing Sheets

HYDRAULIC POWER SHOVEL WITH TAMPING FUNCTION

This application claims priority under 35 U.S.C. § 119 to patent application no. FR 1913948, filed on Dec. 9, 2019 in France, the disclosure of which is incorporated herein by reference in its entirety.

The subject of the disclosure is a hydraulic power shovel that, in addition to its normal use as excavation shovel, also allows it to operate for tamping with the shovel equipment.

BACKGROUND

It is known practice to use power shovels for the compacting of terrains, as is also known from the document US 2011/0013982.

This known shovel uses tamping equipment installed at the end of the rocking arm in addition or instead of the bucket. The movement of the boom with the rocking arm and the equipment at the end makes it possible to tamp the ground in front of the power shovel.

However, this operating mode of the hydraulic power shovel has a certain number of drawbacks. Since the weight of the equipment is used to drop the boom with its tamping equipment, this operation creates a depression with a cavitation effect in the power cylinder which actuates the boom. In addition, the reversing movement between the descent by gravity of the boom, of the rocking arm and of the bucket or of the tamping equipment and then the reverse movement or raising of this equipment is delayed, specifically because of the dead times at the moment of reversal.

SUMMARY

The aim of the disclosure is to develop a hydraulic power shovel that ensures not only the normal function of a shovel but also the tamping function while avoiding the delays at the moment of the reversal of the movement between the descent of the tamping equipment and the raising of the boom for a new tamping phase.

To this end, the subject of the disclosure is a hydraulic power shovel including a frame bearing a turret equipped with an arm (boom, rocking arm) terminated by a tool such as a bucket having a tamping surface, a power cylinder linked to the arm and pressing on the turret, a hydraulic installation with an adjustable flow pump supplying the power cylinder via a slide valve and a hydraulic liquid tank, a control unit linked to a control member actuated by the operator and generating a control signal and a sensor of pressure and of temperature of the hydraulic liquid in the power cylinder generating a signal S (P-T), the vapour pressure diagram of the hydraulic liquid (pressure and temperature) available in the control unit, a comparator receiving the signal from the sensor to compare it to the vapour pressure curve and to generate a control signal for the pump, a control member activated by the operator to supply a signal controlling the operating mode to the control unit, the control unit controlling the operation of the shovel: in normal operating mode according to which the valve and the flow rate of the pump are set as a function of the signal from the control member, in tamping mode according to which, for the free descent of the arm under the effect of its weight, requested by the control member, the valve fully opens the output of the power cylinder to the tank, the pump supplies the input of the power cylinder to maintain the pressure therein above the vapor pressure of the hydraulic liquid but below the atmospheric pressure at the temperature of the hydraulic liquid in the power cylinder.

The hydraulic power shovel according to the disclosure has the advantage of operating very efficiently in the tamping mode. The hydraulic circuit avoids the development of the cavitation effect in the rapid descent of the arm and of the tamping tool under the effect of the weight of this assembly.

This allows the shovel to devote all of its effectiveness to both normal operation and tamping. The return after descent to high position is ensured efficiently since the absence of cavitation and the return of hydraulic liquid in the power cylinder during the descent shortens the time between the end of this movement of descent and the start of the raising of the arm.

In no circumstances does this operation limit the amplitude of the movement of the arm. Depending on the work to be performed, the arm can be raised to any position within the limits of the possible movement of the power cylinder while retaining its effectiveness against the cavitation effect.

According to an advantageous feature, the electronic control unit is a computer applying a program managing the operation in normal mode and in tamping mode.

This electronic control unit can be the unit managing the overall operation of the power shovel and in which the normal and tamping operating modes are program modules.

According to another advantageous feature, the power shovel comprises a manual control device linked to the control unit to switch the control unit to the first or the second operating mode making it possible to activate the movement of descent and of lifting of the arm with the first control device. The second control device is a switch or a pushbutton.

Although the power shovel according to the disclosure advantageously uses the bucket as tamping tool, that does not exclude replacing the bucket with a specific tamping tool installed in place of the bucket.

However, this replacement requires the dismantling of the bucket and the fitting of the tool which blocks the operation of the shovel during this intervention and does not allow the power shovel to be used alternately with its bucket as excavation tool and in parallel, or in the interval, as tamping tool.

BRIEF DESCRIPTION OF THE DRAWINGS

The disclosure will be described hereinbelow, using an exemplary embodiment represented in the attached drawings in which.

DETAILED DESCRIPTION

Figure 1:
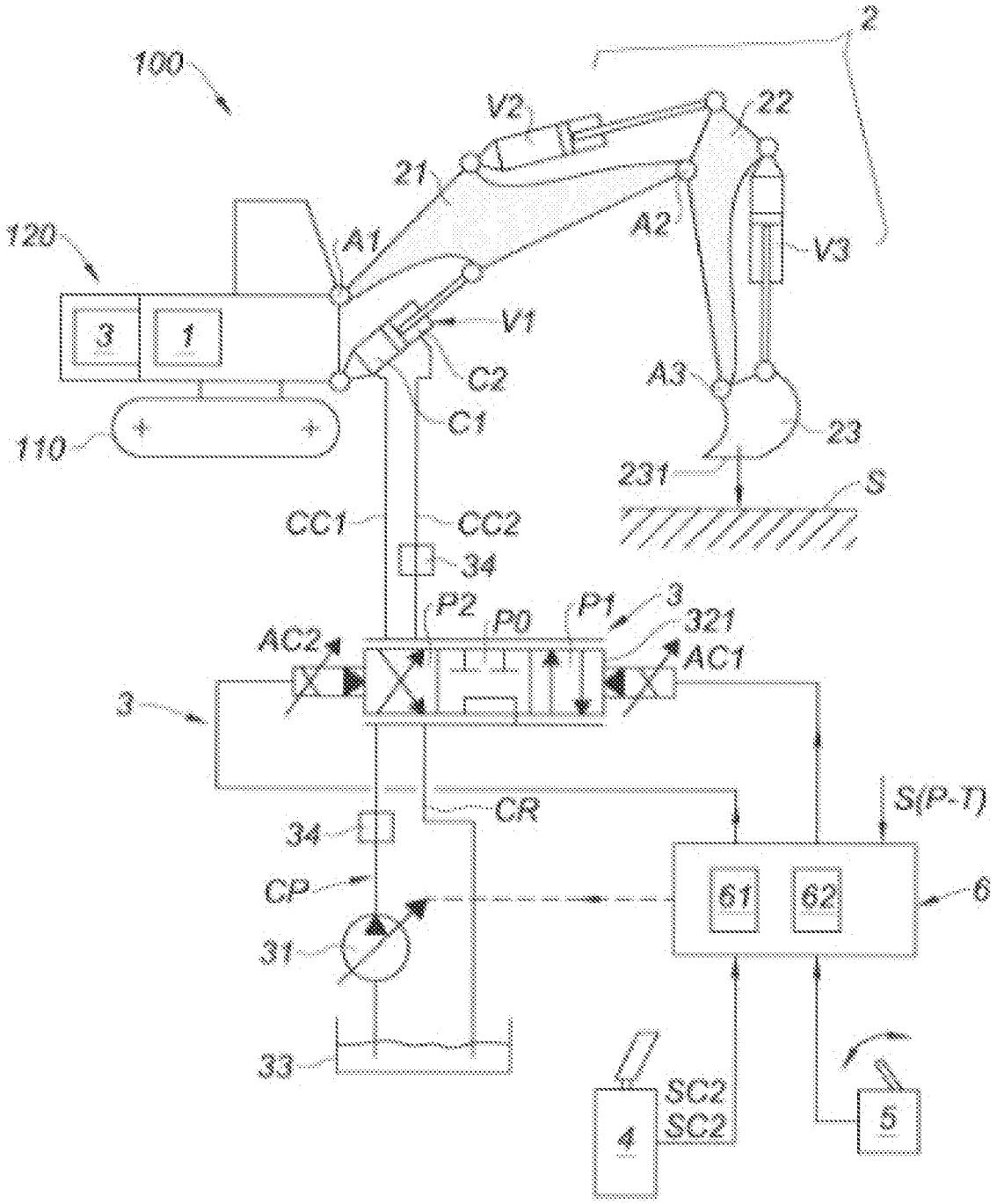
FIG. 1 is a diagram of a hydraulic power shovel according to the disclosure.

FIG. 1 schematically shows a hydraulic power shovel 100 having a mobile frame 110 for example with tracks and supporting a turret 120 with the driving position, the motor 1, the arm 2 with its equipment and the hydraulic installation 3. The arm 2 is formed by a boom 21 linked to the turret 120 by an articulation A1 and a power cylinder V1 controlling the pivoting about this articulation A1. The boom 21 is continued by a rocking arm 22 linked to the boom 21 by an articulation A2 and a power cylinder V2 controlling the pivoting of the rocking arm 22 about the articulation A2.

The end of the rocking arm 22 is linked to a tool 23 such as a bucket by an articulation A3 and a power cylinder V3. The bucket 23 can be tilted to use its outer surface 231 as surface or tamping tool.

The power cylinder V3 controls the movement of the bucket 23; the power cylinder V2 controls the movement of the rocking arm 22 with its bucket 23 and the power cylinder V1 controls the movement of the boom 21 and of the components (22, 23) that it supports, that is to say all of the arm 2.

The power cylinders V1, V2, V3 are supplied in a controlled manner with hydraulic fluid by the hydraulic installation 3 equipped with a pump 31 and valves such as a slide valve 32 according to the movements to be executed. The power cylinders V1-V3 or each group of power cylinders are controlled with associated handles, that are not detailed, for example forming part of a hydraulic control block linked to slide valves such as the valve 32 controlling the hydraulic liquid supplying the power cylinders and possibly other accessories of the power shovel 100.

According to the disclosure, the power shovel 100 can execute not only its normal excavation function (mf1) with its bucket 23, but also the tamping function mf2 with the bucket 23. This tamping function mf2 uses the rigid arm 2 formed by the boom 21, the rocking arm 22 and the bucket 23. This arm 2 pivots, controlled by the power cylinder V1, about the articulation A1 for movements of descent using the force of gravity and of raising of the bucket 23 by supplying the power cylinder V1.

The description of the hydraulic installation 3 will be limited to the means necessary to this operating mode mf2 with the power cylinder V1.

The power cylinder V1 is divided by the piston P into a chamber C1 on the bottom side and a chamber C2 on the power cylinder rod T side. Schematically, the hydraulic liquid in the chamber C1 pushes the rod T and, in the chamber C2, it retracts the rod T.

The chambers C1, C2 are each linked by a respective duct CC1, CC2 ensuring both the intake and the return of the hydraulic liquid, from and to a slide valve 32 which is itself linked to a duct CP coming from the pump 31 and a return duct CR to the tank 33 from which the pump 31 is supplied.

To facilitate and simplify the description, since the role of the chambers C1, C2 is reversed for the lifting of the arm 2 (or of the boom 21) and for the descent thereof, the link between a chamber C1, C2 and its respective duct CC1, CC2 will be designated according to the active direction of passage of the hydraulic liquid:

for lifting:
input EC1 of the chamber C1
output SC2 of the chamber C2
for descent
output SC1 of the chamber C1
input EC2 of the chamber C2
in other words:
- in lifting, the pump 31 supplies the power cylinder through its chamber C1 (input EC1)
- in descent, the pump 31 supplies the power cylinder V1 through its chamber C2 (input EC2).

The hydraulic installation 3 is managed by a control unit 6 linked to a first control member 4 in the form of a handle and to a second control member 5 to switch between the functions mf1 and mf2. This control member 5 is in the form of a handle or of a pushbutton. The switching can also be done on the basis of the repeated actuation according to a certain pattern, of the control member 4 which is interpreted as a signal for switching between the two functions mf1, mf2 by the control unit 6.

The first control member 4 manages the operating mode mf1 or mf2 of the power cylinder V1 out of the two operating modes selected by the second control member 5, namely:

normal operation mf1
tamping mf2.

The tamping mf2 is the operating mode that is more particularly the concern of the disclosure.

Tamping consists in packing the ground with the bucket 23 pivoted about the articulation A3 with the rocking arm 22 to present the outer surface 231 of the bucket 23 as compacting surface. The repeated movement of raising and of descent of the arm 2 is controlled by the operator with the handle 4. This movement must be repeated as rapidly as is permitted by the operation of the hydraulic circuit 3 and the kinematics of the arm 2.

According to the disclosure, the valve 32 has three switching ranges Po, P1, P2 on its slide 321 for cutting the two ducts CC1, CC2 of the power cylinder V1 or linking them to the two ducts CP, CR corresponding respectively to the intake from the pump 31 and to the return to the tank 33.

The range Po of the valve closes the two ducts CC1, CC2 and thus blocks the power cylinder V1 in its position, that is to say the position of the piston P of the power cylinder V1 at that moment.

This range Po also ensures the closure of the ducts CP, CR or, as a variant, the return of the duct CP to the duct CR and the tank 33 which allows the pump 31 to continue to operate while the power cylinder V1 is cut from the circuit.

The range P1 links the chamber C1 to the pump 31 and the chamber C2 to the tank 33.

The range P2 links the chamber C2 to the pump 31 and the chamber P1 to the tank 33.

The ranges P1, P2 reverse the operation of the power cylinder V1 and between them, the range Po blocks the operation of the power cylinder V1.

To simplify the language, this range P1 corresponds to the active supplying of the power cylinder V1 by the pump 31 while the range P2 corresponds to the passive operation of the power cylinder V1 whose chamber C1 is emptied under the effect of the piston P pushed by the weight of the arm 2.

The unit 6 controls the valve 32 by displacing the slide 321 by its two actuators AC1, AC2 at the two ends of the slide 321 which push and pull the latter into the chosen position, opposite the ducts C1, C2 or CP, CR. In mode mf2, the ranges P1, P2 are not proportional; they fully open or close the passage of the hydraulic liquid and the switching between the ranges P1 and P2 goes through the range Po regardless of the switching direction.

The control unit 6 manages the operation of the pump 31 (flow rate Q of the pump) based on instructions from the handle 4 and information supplied by sensors that are not represented, monitoring the operation of the hydraulic installation 3.

The control unit 6 is linked to a pressure sensor 34 which detects the pressure in the chamber C2 of the power cylinder V1 and associated with the duct CC2 linked to the chamber C2 or to the output duct CP of the pump 31. The sensor 34 or another associated sensor measures the temperature of the hydraulic liquid in the chamber C2 of the power cylinder or at the input of this chamber. It supplies the signal of pressure SP and of temperature ST to the control unit 6.

This signal is also represented in the combined form of pressure and temperature signal S(P-T) whether supplied by itself or two sensors.

The control unit 6 comprises, in memory, the vapour pressure curve of the hydraulic liquid 61 and a comparator 62 for comparing the pressure signal S(P-T) supplied by the sensor 34 to the vapour pressure curve of the hydraulic liquid to control the operation of the pump 31.

The vapour pressure diagram of the hydraulic liquid is a known curve, not represented, with coordinates (T, P) separating the liquid state and the gaseous state. The cavitation occurs schematically when the pressure of the liquid drops below the constant temperature vaporization curve while the transition of the constant pressure and increasing temperature curve is reflected by the boiling of the liquid.

The operation according to the first mode mf1 consists in controlling the upward and downward pivoting of the arm 2 or of the boom 21 by supplying the chamber C1 or the chamber C2.

The operation according to the second mode mf2 is different in that it uses the weight of the arm 2 (boom, rocking arm and bucket) to lower the arm 2 and strike the surface of the ground to be tamped S under the bucket 23.

The manoeuvring of the handle 4 is reflected by the sending, to the unit 6, of a control signal SC1, SC2 for the raising or lowering manoeuvring of the arm 2.

It is assumed that, initially, the arm 2 is lowered, for example bearing on the ground or even in any position between its raised position (depending on the maximum travel of the power cylinder V1) or in an intermediate position depending on the stop at the end of the manoeuvre. The slide 321 is, by definition, in its neutral position Po blocking the power cylinder V1.

The manoeuvre to be performed is that of tamping (in the operating mode mf2).

The unit 6 detects the start of the movement of the handle 4 and interprets it as a request to supply the power cylinder V1 in the direction of lifting of the arm 2. The unit 6 pushes the slide 321 to set up the range P1 and supply the chamber C1 (active supply) and at the same time link the chamber C2 to the return CR to the tank 33.

The operator manoeuvres the handle 4 into an intermediate position or to the end of travel.

The manoeuvre continues as long as the handle is actuated and the power cylinder V1 can operate in this direction, that is to say until the chamber C1 is totally filled. A travel or pressure sensor associated with the chamber C1 stops the pump 31 or switches the slide 321 to switch over to the range Po.

At the end of this operation, the operation of the arm 2 is stopped and, if the handle 4 is not placed in its rest position, it must be returned thereto; it can also be released by the operator and revert automatically to that position.

The manoeuvre which should follow the raising of the arm 2 is detected by the control unit 6 which controls the slide 321 to set its range P2 in active position and link the duct CR to the duct CC1 and the duct CP to the duct CC2.

The communication through the slide 321 is fully open for the two ducts CC1, CC2, that is to say without the flow rate leaving the chamber C1 in return to the liquid tank 33 (also called tank), or the flow rate Q from the pump 31 to the chamber C2, being laminated.

The pump 31 supplies output under the control of the unit 6 and supplies the chamber C2 for the pressure therein to remain slightly above the vapour pressure of the hydraulic liquid at that temperature and below atmospheric pressure, so as to avoid the cavitation or the onset of cavitation, without loading the chamber C2 beyond what is necessary, and not delay the subsequent manoeuvre of lifting of the arm 2.

To control the pump 31 and its flow rate/pressure Q, the control unit 6 compares the pressure of the hydraulic liquid in the chamber C2 supplied by the pump 31 to the vapour pressure at the temperature of the hydraulic liquid in the chamber C2 to servocontrol the flow rate Q from the pump 31, so that, when the movement of descent of the bucket 23 is stopped, not necessarily at the end-of-travel position of the piston P in the cylinder, the reverse movement can begin immediately.

This state is detected by the detection of the change of pressure gradient in the chamber C2 of the boom power cylinder V1, provoked by the impact on the ground. That is reflected by a pressure peak. Normally, the operator instinctively reverses the control 4 at the moment when he or she hears the noise provoked by the noise of the impact of the bucket on the ground. The slide 321 is thus automatically set in the position Po to block the arm 2 and avoid any movement before the arm 2 can be raised as required, controlled by the operator.

Upon this automatic stop at end of descent travel under the effect of the weight, the handle 4 may still be in its end of descent phase of the arm 2 position.

For the next phase of lifting of the arm 2, the handle 4 must go back through its rest position. Then, when the handle 4 is actuated, the control unit 6 detects the start of control and sets the slide 321 of the valve in position P1 to supply the chamber C1 and lift the arm 2 to the end of the travel of the power cylinder V1 or to a heightwise position, chosen by the operator, depending on the work to be performed. The tamping cycle then recommences.

Figure 2A:
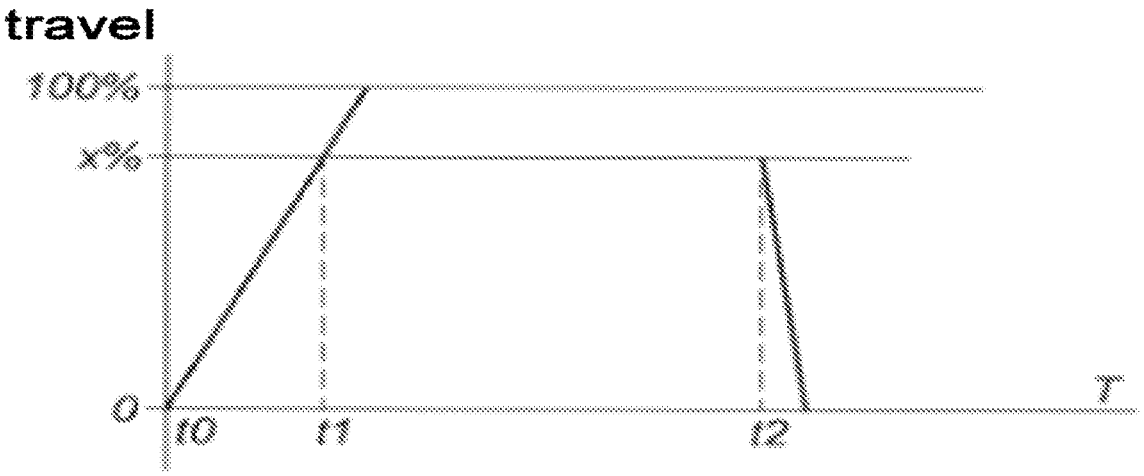
FIG. 2A is a graph of the movement of the control handle.
Figure 2B:
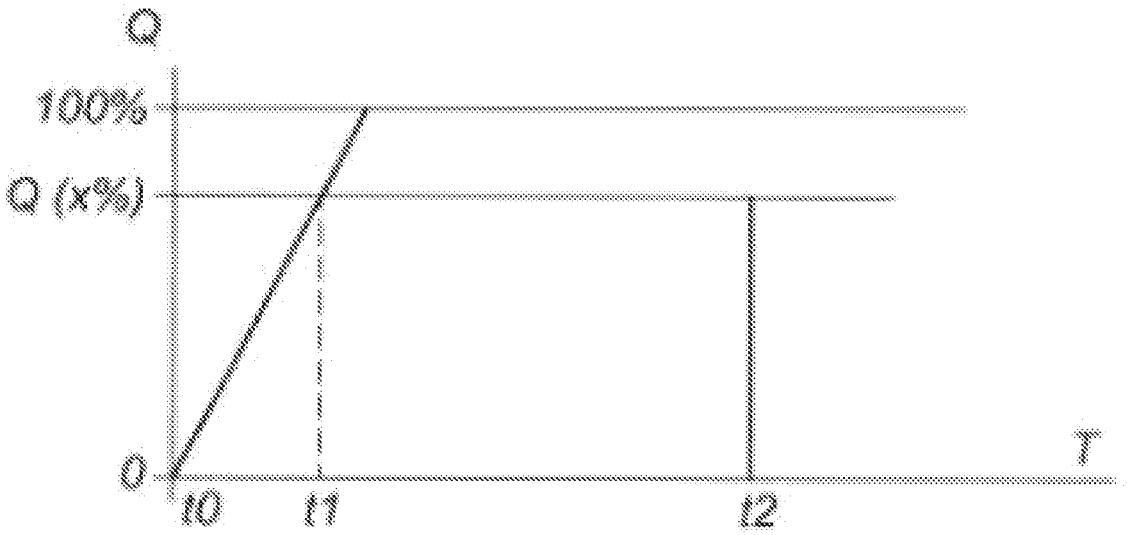
FIG. 2B is a graph of the response to the movement of the handle for the control of the hydraulic circuit pump.

The handle 4 controls the pump 31 as is illustrated by the curves of FIGS. 2A, 2B.

FIG. 2A represents the diagram of operation of the handle 4 with, on the x axis, the time T, and on the y axis, the travel of the handle 4.

The travel is represented on a scale of between 0% and 100% of the total travel.

Starting from the origin 0 (0%, to), the movement of the handle 4 is, for example, linear. The travel can be stopped at any level, for example X % of the total travel. When this point chosen by the operator is reached (instant t1), he or she maintains the handle 4 until the instant t2 then raises or lowers or releases the handle. It then reverts automatically to the 0% x axis position in a relatively short return time.

FIG. 2B shows the control function applied by the control unit 6 to the pump 31 to control the flow rate Q thereof. This function is assumed linear. It is represented in relation to time with the curve of FIG. 2A. The y axis here represents the flow rate Q as a percentage relative to the maximum flow rate (100%) of the pump 31. The degree of actuation (X %) of the handle 4 corresponds to a flow rate Q (X %).

The operation of the pump 31 is the image of the actuation of the handle 4 as long as the request represented by the signal from the handle 4 is compatible with the known operating capabilities of the power cylinder V1 and applied by the control unit 6.

According to the disclosure, the flow rate Q of the pump 31 supplying the chamber C2 is set so that the descent of the bucket 3 by gravity does not create, in the chamber C2, a depression lower than the vapour pressure of the hydraulic liquid or that the pressure of the hydraulic liquid does not create a thrust on the piston that is added to that of the weight exerted by the arm 2, so as to avoid the cavitation in the power cylinder or not to increase the time of reversal of the movement of the boom for its future lift.

The delay on the lifting of the arm 2 after its descent would be created by the time needed to first fill the chamber C2 from empty on stopping or, in the reverse direction, to discharge the hydraulic liquid under pressure from the chamber C2, delaying the intake of the hydraulic liquid into the chamber C1.

The repetition of the working tamping cycles comprises, for each cycle:

- a phase of lifting of the arm 2 to the necessary height which is that corresponding to the end of travel of the power cylinder V1 or to an intermediate position
- a phase of descent, releasing the arm 2 and its load to the action of the weight until the bucket 23 (or the tamping tool) strikes the ground S.

The control unit 6 is preferably a computer applied to a program to manage the operation of the power shovel 100 and the observance of safety conditions in normal mode (mf1) and in tamping mode (mf2).

PARTS LIST OF MAIN ELEMENTS

100 Hydraulic power shovel
110 Frame
120 Turret
1 Motor
2 Arm
21 Boom
22 Rocking arm
23 Tool/bucket
231 Tamping surface
3 Hydraulic installation
31 Adjustable pump
32 Slide valve
321 Slide
33 Hydraulic liquid tank, tank
34 Pressure/temperature sensor
4 Handle
5 Other control member
6 Control unit UC
61 Diagram (P-T) of the hydraulic liquid
62 Comparator
A1, A2, A3 Articulations
V1, V2, V3 Power cylinders
P Piston of the power cylinder V1
T Rod of the power cylinder V1
C1, C2 Chambers of the power cylinder V1
CC1, CC2 Ducts linked to the chambers of the power cylinder
CP Output duct from the pump
CR Return duct to the tank
S Ground
SC Signal from the control member 4
S (P-T) Pressure-temperature signal of the hydraulic liquid in the power cylinder V1
SP Pump 31 control signal
SCmf Control signal for switching between the operating modes
mf1 Normal mode
mf2 Tamping mode

What is claimed is:

1. A hydraulic power shovel comprising:

a frame supporting a turret equipped with an arm;

a power cylinder linked to the arm and configured to press on the turret;

a hydraulic installation including an adjustable flow pump configured to supply the power cylinder via a slide valve and a hydraulic liquid tank;

a control unit operably connected to a first control member and a sensor, the first control member actuated by an operator and configured to generate a first operator control signal, the sensor configured to generate a sensor signal corresponding to pressure and temperature of hydraulic liquid in the power cylinder, wherein a vapour pressure diagram of the hydraulic liquid is available in the control unit;

a comparator configured to receive the sensor signal, to compare the sensor signal to a vapour pressure curve, and to generate a pump control signal for the adjustable flow pump; and a second control member activated by the operator and configured to generate a second operator control signal for controlling an operating mode of the control unit, wherein the control unit is configured to control operation of the hydraulic power shovel:

in a normal operating mode according to which the slide valve and a flow rate of the adjustable flow pump are set as a function of the first operator control signal from the first control member; and in a tamping mode according to which the arm is configured for a free descent under effect of its weight as requested by the first control member, wherein the slide valve fully opens an output of the power cylinder to the hydraulic liquid tank, and wherein the adjustable flow pump is configured to supply an input of the power cylinder to maintain a pressure therein above a vapour pressure of the hydraulic liquid but below atmospheric pressure, at the temperature of the hydraulic liquid in the power cylinder.

2. The hydraulic power shovel according to claim 1, wherein the control unit is a computer configured to apply a program managing operation in the normal mode and in the tamping mode.

3. The hydraulic power shovel according to claim 2, wherein:

the second control member is a manual control device operably connected to the control unit and configured to switch the control unit to the first operating mode and the second operating mode, lifting movement of the arm is controlled by the first control device, and the second control device includes a switch or a pushbutton.

4. The hydraulic power shovel according to claim 1, wherein:

the arm is terminated by a tool, and the tool is a bucket having a tamping surface.

* * * * *